United States Patent [19]

Bolin

[11] Patent Number: 4,646,714

[45] Date of Patent: Mar. 3, 1987

[54] FRICTION HEAT GENERATOR

[76] Inventor: Charles E. Bolin, 4009 Prince La., Jeffersontown, Ky. 40299

[21] Appl. No.: 298,846

[22] Filed: Sep. 3, 1981

[51] Int. Cl.[4] ..... F24C 9/00

[52] U.S. Cl. ..... 126/247; 122/26; 126/110 R

[58] Field of Search ..... 126/247, 110 R; 122/26; 165/86; 415/71, 206, 72, 73; 416/146 R

[56] References Cited

U.S. PATENT DOCUMENTS

| | | | |
|---|---|---|---|
| 1,657,055 | 1/1928 | Woodcock | 415/72 |
| 1,682,102 | 8/1928 | Allen | 126/247 |
| 1,943,053 | 1/1934 | Boisset | 126/110 R |
| 2,498,143 | 2/1950 | Struckmann | 415/72 |
| 2,660,160 | 11/1953 | Murphy | 126/110 R |
| 2,884,048 | 4/1959 | Marble et al. | 126/110 R |
| 3,474,773 | 10/1969 | Brignal et al. | 126/247 X |
| 3,561,906 | 1/1969 | Fermér | 415/206 |
| 3,813,036 | 5/1974 | Lutz | 126/247 X |
| 4,197,447 | 4/1980 | Jones | 126/110 R X |

*Primary Examiner*—Larry Jones

*Attorney, Agent, or Firm*—Richard L. Caslin

[57] ABSTRACT

A friction heat generator is shown for use as the heat source of a furnace heating system. This heat generator has an oil-filled, cylindrical housing supporting a longitudinal auger in close-fitting, running relationship. The housing is substantially filled with oil, and an external motor is joined to the shaft of the auger for driving the auger at a high speed for moving the oil towards one end of the housing. An auxiliary pump is located adjacent that one end of the housing, and it is provided with a discharge port for carrying off the heated oil from the housing at an increased volumetric capacity. Cooperating with the friction heat generator is a heat exchanger that is joined to the generator by conduits to form a closed, recycling heating system. Several modifications of auxiliary pumps are provided in the form of a rotary impeller, as well as one including a plurality of piston pumps acting off a rotary cam.

8 Claims, 8 Drawing Figures

FRICTION HEAT GENERATOR

BACKGROUND OF THE INVENTION

1. Field of the Invention

This invention relates to friction heat generators for creating a source of heat to use in a heat exchanger for a warm air furnace heating system for use in the home.

2. Description of the Prior Art

Friction heaters have been known for many years, as is clear from the Kilbourn U.S. Pat. No. 361,164 which describes an air compressor that forces air into a cylinder in which is journaled a longitudinal shaft with spirally-arranged beaters or blades to subject the compressed air to frictional mechanical agitation until a required degree of heat is attained.

The Crocket et al U.S. Pat. No. 2,107,933 describes a heating system for buildings and the like utilizing the heat of friction of a gas or a liquid under pressure that is forced through a circulating system including heat radiators. This system includes an air compressor that feeds into a positive-acting pump or impeller which is shown as of the screw type in which the slippage of air past the impelling means is reduced to a minimum. The fluid-impelling screw is rotated by means of a pulley driven by steam or electrical motor or water or wind power. Due to the fact that the impelling element and the inner wall of the casing are smooth, no appreciable amount of heat will be generated at the pump or impelling means. The coils or passages of the radiators, however, may have their interior surfaces interrupted or roughened in any suitable manner so as to provide frictional resistance to the flow of fluid through the radiator.

The Love et al U.S. Pat. No. 2,625,929 describes a friction heat generator that includes a longitudinal motor-driven shaft which supports friction discs as well as pairs of friction bars. Oil fills the cylindrical casing, and the movement of the discs and the bars will produce frictional heat for the purpose of heating water or the like.

The Smith U.S. Pat. No. 2,683,448 describes a rotary mechanical heater for converting mechanical energy into heat. Heat is produced by shearing a liquid with unequal numbers of rotary and stationary blades. The rotation of the rotors circulates the liquid through a heat exchanger over which air is circulated by a blower for distributing the heated air to radiators and the like.

The Love U.S. Pat. No. 3,402,702 describes a friction heat generator having a cylindrical casing with a plurality of juxtaposed discs having a central shaft therethrough. Certain discs are rotatable and others are fixed, and each disc is formed with a chamber. The chambers of the non-rotatable discs are filled with material of low heat conductivity, and the chambers of the rotatable discs are filled with material of high heat conductivity.

The Lutz U.S. Pat. No. 3,813,036 describes a heating system utilizing a closed oil system and a friction element which is formed of woven metal wire, such as stainless steel, that is highly compressed for heating the oil as the oil is forced through the element.

The Frenette U.S. Pat. No. 4,143,639 describes a furnace or space heater having an electric motor which rotates an elongated cylindrical drum on a vertical axis within an elongated cylindrical casing at a clearance of about $\frac{1}{8}$/th of an inch in the annular chamber formed therebetween. A supply of relatively light oil normally occupies the lower portion of the annular chamber, but rises to fill the chamber during rotation of the drum.

The casing is enclosed in a housing, and the motor may rotate both a fan as well as the drum.

OBJECTS OF THE PRESENT INVENTION

The principal object of the present invention is to provide a friction heat generator having a high operating efficiency and incorporating the combination of an oil-filled, cylindrical housing that is provided with a motor-driven shaft having a positive displacement means for pumping the oil, and an auxiliary pumping means driven by the shaft for increasing the volumetric capacity.

A further object of the present invention is to provide a friction heat generator of the class described where the positive displacement means is a longitudinal auger in close-fitting relationship with the housing, and the auxiliary pumping means includes a rotary impeller for discharging the heated oil from the housing.

A further object of the present invention is to provide a friction heat generator of the class described where the auxiliary pumping means is formed by a plurality of piston pumps driven from a rotary cam on the shaft of the heat generator.

A further object of the present invention is to provide a friction heat generator of the class described in conjunction with a heat exchanger and conduit means for forming a closed, recycling heating system employing the heat generator and the heat exchanger.

SUMMARY OF THE INVENTION

The present invention provides a friction heat generator for use as the heat source of a furnace heating system. The generator includes an oil-filled, cylindrical housing that supports a longitudinal, rotatable shaft having positive displacement means, such as an auger that is close-fitting relationship with the cylindrical housing. This shaft is driven by an external power source, such as an electric motor. An auxiliary pumping means is positioned within the housing at one end thereof, and it is operable from the rotatable shaft. There is a discharge port in the housing for carrying off the heated oil from the auxiliary pumping means. This friction heat generator is connected in series with a heat exchanger by conduit means to form a closed, recycling heat system.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
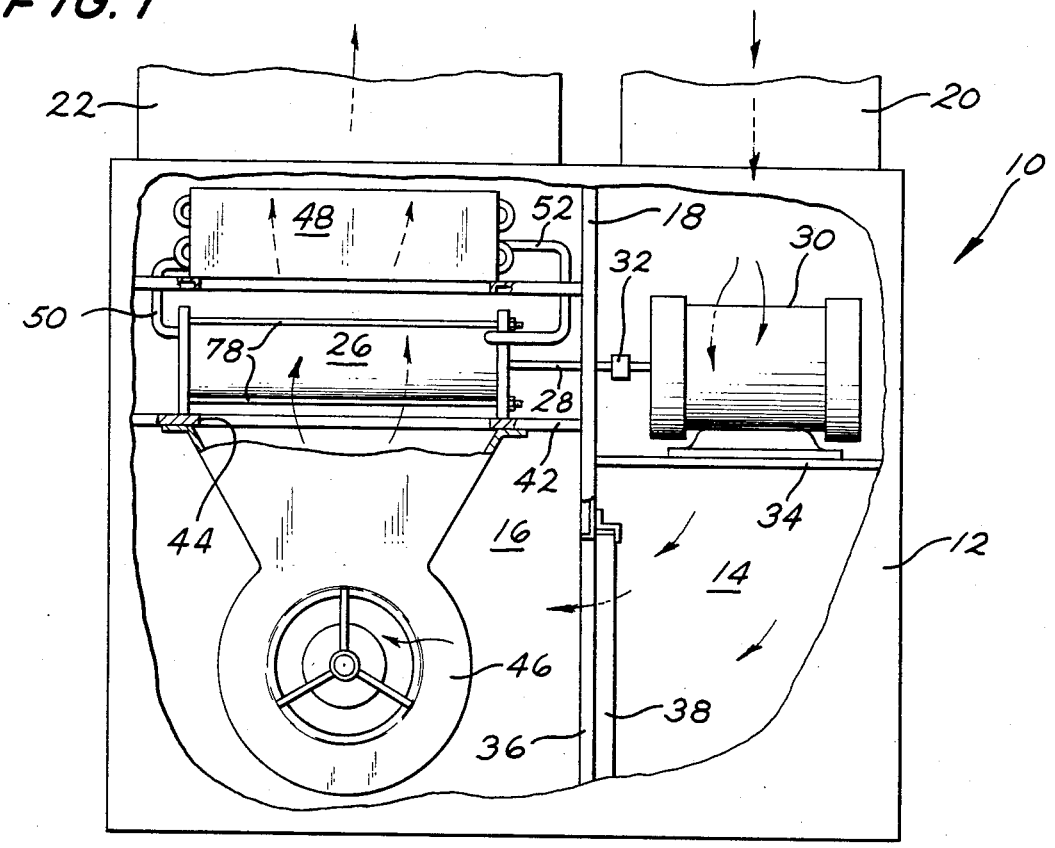
FIG. 1 is front elevational view of a warm air furnace with parts broken away to show a motor-driven, friction heat generator embodying the present invention in combination with a return air duct, a motor/blower unit, and a heat exchanger arranged in series with the friction heat generator in order to form a closed, recycling heating system, as well as a warm air duct that is adapted to be connected to the warm air ducts throughout the residence or building to be heated.

Turning now to a consideration of the drawings, and, in particular, to the front view of FIG. 1, there is shown a warm air furnace 10 having a hollow, sheet metal housing 12, which is separated into two main compartments 14 and 16 by a vertical partition 18 that is located near the center of the housing. At the top of the housing, there is a return air duct 20 that empties into the first main compartment 14, while there is a primary air duct 22 that carries warm air from the second main compartment 16 for delivering warm air t the heating ducts and registers throughout the residence or other building to which the furnace system is servicing.

This warm air furnace 10 includes within its housing 12 four main elements; the first of which is the most important; namely, a friction heat generator 26, which embodies the present invention. This friction heat generator 26 has a shaft member 28 which extends externally thereof and through a suitable hole in the partition 18 for coupling with an electric motor 30 by means of the coupler 32. This motor 30 is supported on horizontal straps or motor supports 34. The lower portion of the vertical partition 18 is provided with a large opening 36 which is fitted with a furnace filter 38 for cleaning the air of dust and other objectionable particles before the air passes through to the second main compartment 16.

The friction heat generator 26 is supported on a horizontal shelf 42. A large opening 44 is formed inthe shelf beneath the friction heat generator 26, and a motor/-blower unit 46 is suspended from the shelf 42 beneath the opening 44 for drawing in the return air that passes through the filter 38 into the compartment 16 and forces it up over the friction heat generator 26. Above the friction heat generator 26 is mounted a heat exchanger 48 which is connected in series with the friction heat generator 26 by means of conduits 50 and 52.

Figure 2:
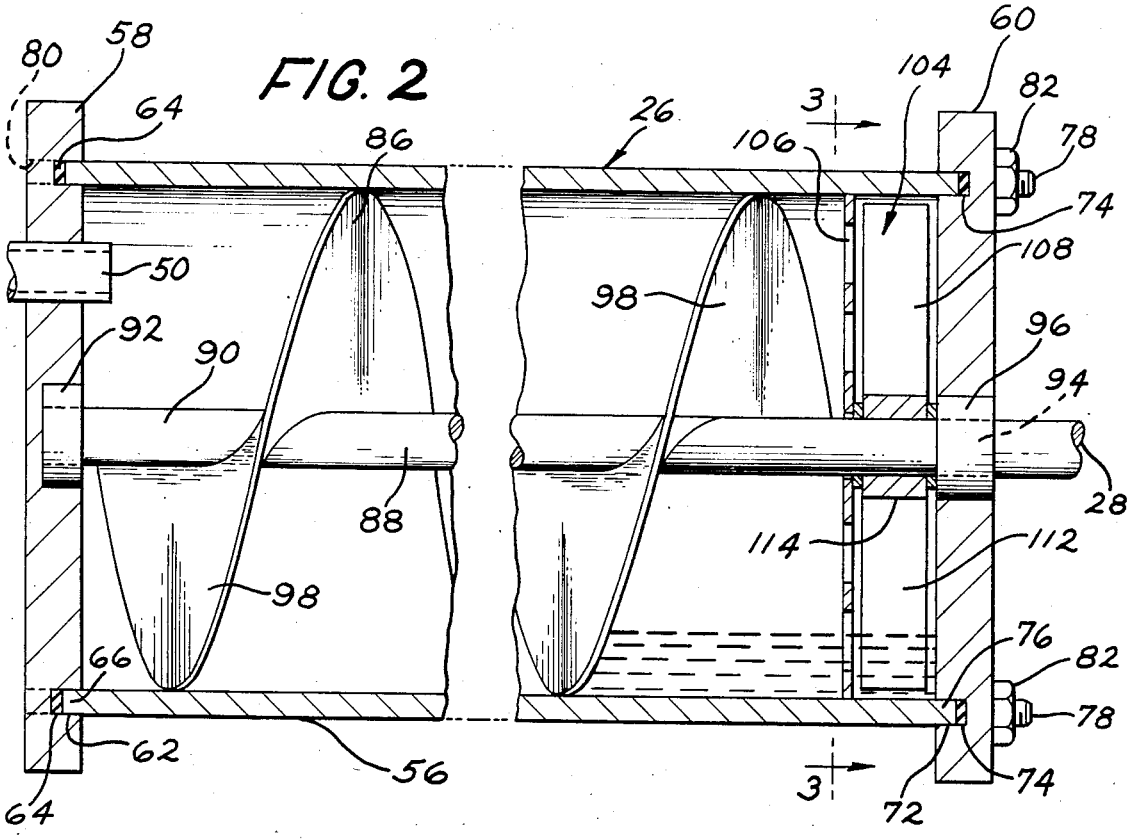
FIG. 2 is a longitudinal, cross-sectional, elevational view, on an enlarged scale, of the friction heat generator embodying the present invention showing the auger in close-fitting relationship with the cylindrical housing, as well as an auxiliary pumping means having a rotary impeller joined to the shaft for delivering the heated oil to the discharge port from the housing.

FIG. 2 shows an enlarged scale of the friction heat generator 26 shown in a longitudinal, cross-sectional, elevational view. This friction heat generator 26 comprises a cylindrical drum 56, which is closed at the two ends by two opposite end plates 58 and 60. The end plate 58 is provided with a circular groove 62 which receives a circular gasket 64, and the adjacent end 66 of the cylindrical drum 56 fits into the groove 62. In a similar manner the end plate 60 is provided with a circular groove 72 for receiving a circular gasket 74 as well as the adjacent end 76 of the drum 56.

Figure 3:
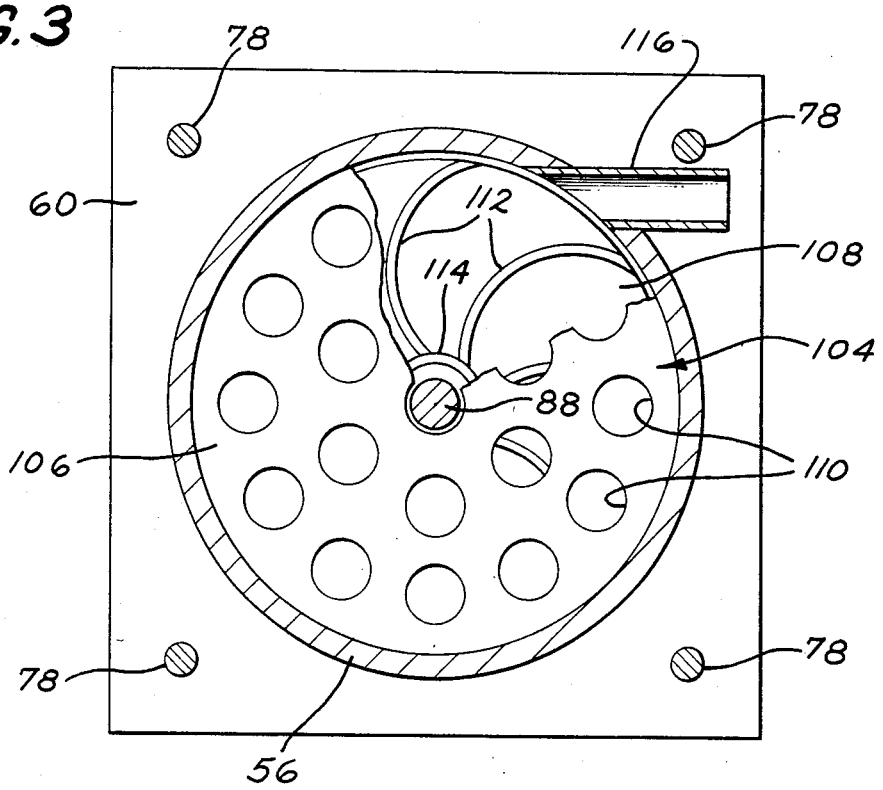
FIG. 3 is a transverse, cross-sectional view through the cylindrical housing of the friction heat generator, taken on the line 3—3 of FIG. 2. A perforated baffle plate is shown, and a part of the baffle plate is broken away to expose the rotary impeller to view, as well as show the tangential discharge port from the housing.

Now turning to the transverse, cross-sectional view of FIG. 3, which is taken on the line 3—3 of FIG. 2, the end plate 60 is shown as a square plate that is fitted with a tie rod 78 that extends through a small hole adjacent each corner of the square plate. One end of each tie rod is provided with threads (not shown) which are screwed into a threaded hole 80 in the end plate 58. The opposite end of each tie rod is also threaded and it extends through a suitable hole in the opposite end plate 60 for receiving a nut 82 that is tightened down to pull the two end plates 58 and 60 together until they form a sealed cylindrical housing with the drum 56. Of course there are other methods of forming a cylindrical housing, but the above described design is considered to be a preferred embodiment.

Supported within the cylindrical drum 56 of the friction heat generator 26 is a longitudinal auger 86 which is provided with a central drive shaft 88. One end of the drive shaft 90 is supported in a rotary bearing 92 which is seated in a central recess in the end plate 58. The opposite end 94 of the drive shaft 88 extends into a through bearing 96 that is mounted centrally in the opposite end plate 60. Notice that the portion of the drive shaft 88 that is external of the cylindrical drum 56 is identified by the reference numeral 28 as is best seen in FIG. 1. This external shaft is joined to the coupler 32 that connects shaft 28 with the drive shaft of the electric motor 30. It should be understood that this longitudinal auger 86 has spiral blades inthe nature of screw threads 98 which serve as a positive displacement means when the cylindrical drum 56 is filled with about ten quarts of a suitable, light weight oil such as a high temperature aircraft oil.

Also shown in FIG. 2 is an auxiliary pumping means 104 which includes a transverse baffle plate 106 adjacent one end of the drum 56 as well as a rotary impeller 108. The nature of this auxiliary pumping means 104 can best be understood with reference to FIG. 3. The transverse baffle plate 106 includes a plurality of spaced perforations 110 so that the auger 86 will force the oil through the perforations 110 and deliver the oil to the rotary impeller 108. This rotary impeller 108 is provided with a plurality of curved vanes 112 which are each mounted on a common central hub 114 that is joined to the drive shaft 88 of the auger and moves therewith. A tangential discharge port 116 is supported through the wall of the cylindrical drum 56 in cooperation with the auxiliary pumping means 104 to carry off the oil at an increased volumetric capacity or rate in gallons per minute. One optimum discharge rate is at about 6 gallons per minute of heated oil passing out of the friction heat generator 26 so as to move through the conduit 52, as seen in FIG. 1 and into the heat exchanger 48. After this heated oil passes completely through the heat exchanger 48 it exits from the heat exchanger by way of the conduit 50 that is connected back into the cylindrical drum 56 as is best seen in FIG. 2. In one preferred embodiment of the present invention the electric motor 30 is a 5 horsepower motor for driving the auger 86. It turns at a speed of about 1,740 RPM.

Figure 4:
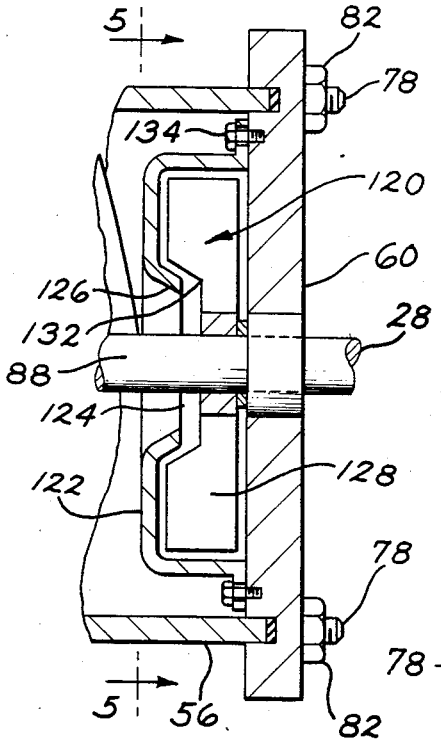
FIG. 4 is a fragmentary, longitudinal, cross-sectional view, similar to that of FIG. 2, but only showing the right-hand end of the cylindrical housing with a second modification of auxiliary pumping means as a substitute for the pumping means of FIG. 3.
Figure 5:
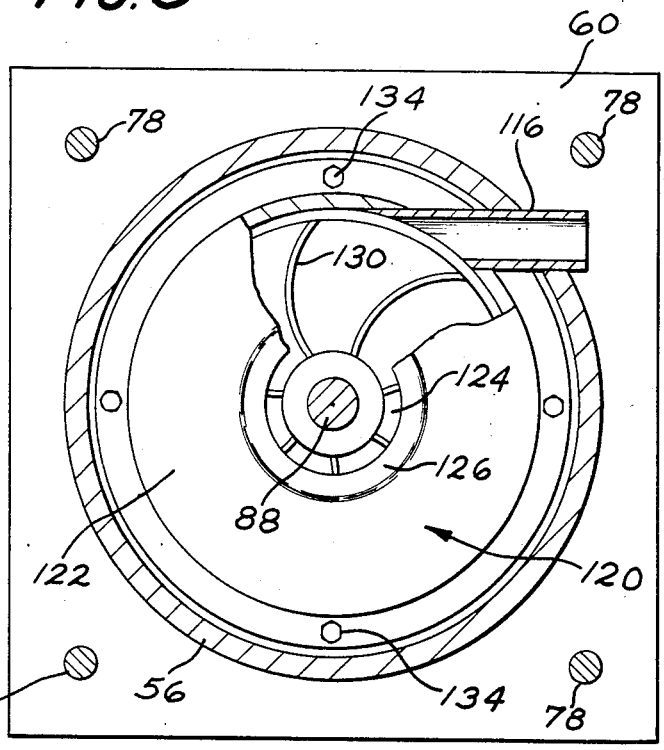
FIG. 5 is a transverse, cross-sectional view showing this second modification of auxiliary pumping means, and taken on the line 5—5 of FIG. 4.

A second modification of the auxiliary pumping means is shown in FIGS. 4 and 5 as auxiliary pumping means 120. This second auxiliary pumping means 120 has a funnel-shaped cover plate 122 that has a central opening 124 that is furnished with a tapered inlet 126. A rotary impeller 128 is fixed to the drive shaft 88 in a manner similar to the rotary impeller 108 of the first modification of FIGS. 2 and 3. This rotary impeller has circular vanes 130 which are cut away as at 132, as best seen in FIG. 4, so as to accommodate the tapered inlet 126. Thus in this second modification of auxiliary pumping means the heated oil is forced by the auger 86 through the central opening 124 in the funnel-shaped cover plate 122, and then the circular vanes 130 of the rotary impeller exert a centrifugal force to the oil to force the oil out o the tangential discharge port 116 that is connected to the conduit 52, as best seen in FIG. 1. Notice that the cover plate 122 of this second modification of auxiliary pumping means is mounted to the end plate 60 by means of fastening screws 134.

Figure 7:
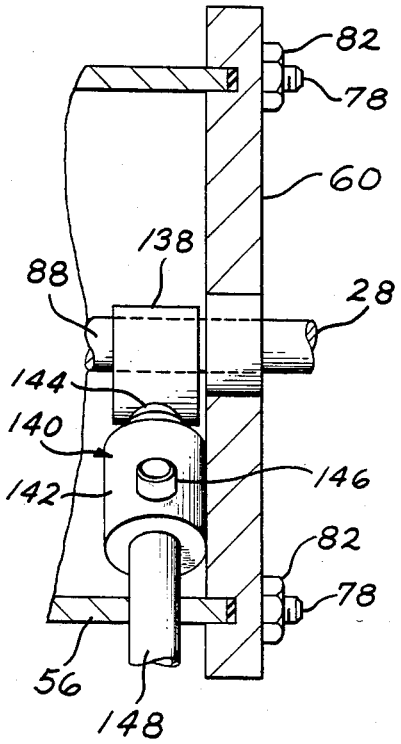
FIG. 7 is a right-side, elevational view of FIG. 6 taken along the longitudinal, center plane of the cylindrical housing and showing one of the piston pumps operating in conjunction with the rotary cam of the auger.
Figure 6:
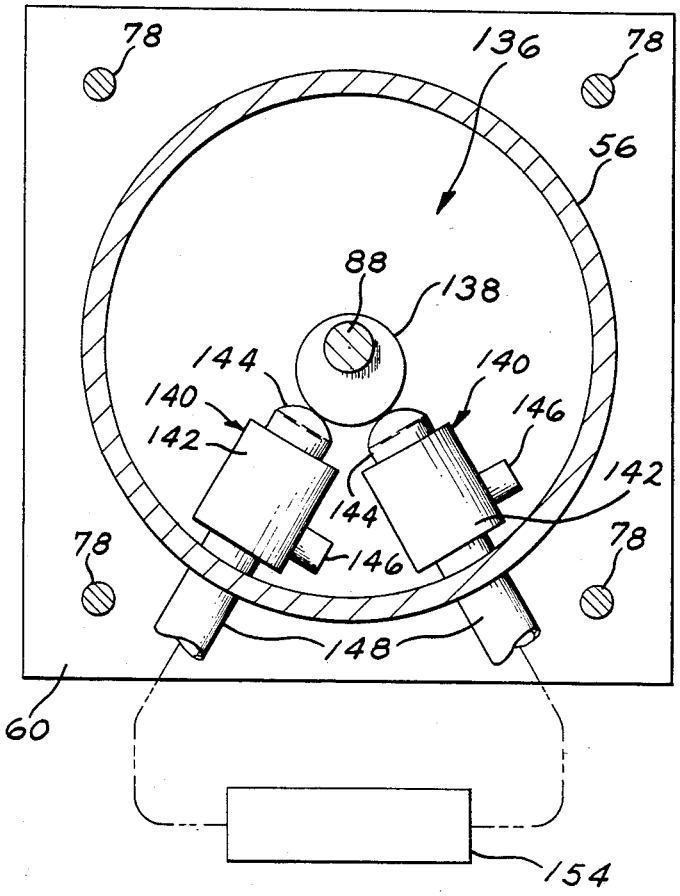
FIG. 6 is a transverse, cross-sectional view of the cylindrical housing showing a third modification of auxiliary pumping means in the form of a plurality of piston pumps which operate in conjunction with a rotary cam on the shaft of the auger.
Figure 8:
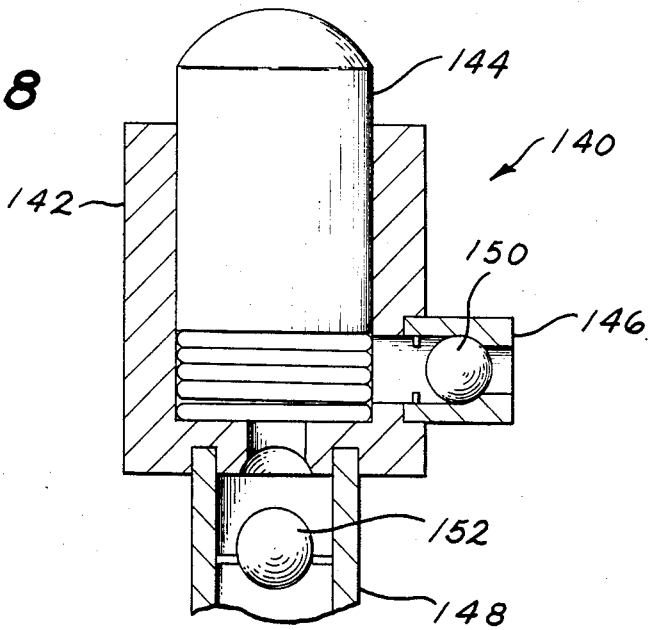
FIG. 8 is a cross-sectional, elevational view, on an enlarged scale, of one of the piston pumps of FIG. 6 showing its internal construction to facilitate an understanding of its operation.

A third modification of auxiliary pumping means 136 is shown in FIGS. 6-8. Looking first at FIG. 6, the drive shaft 88 of the longitudinal auger is provided with a rotary cam 138. Associated with this rotary cam is a plurality of piston pumps 140 which are mounted in a radial fashion to the wall of the cylindrical drum 56. Each piston pump is provided with a pump housing 142 that supports a spring-biased piston 144 that is urged to bear against the rotary cam 138. Each piston pump has an intake port 146, as best seen in FIG. 8, as well as an exhaust port 148. The intake port is provided with a ball valve 150, while the exhaust port is provided with a ball valve 152. When the piston 144 moves outwardly of the pump housing 142 it draws the ball valve 150 of the intake port into an open position thereby allowing heated oil to enter the pump interior. When the reverse action takes place and the piston 144 moves inwardly of the pump housing 142 then this action causes the ball valve 150 to close the intake port and at the same time to open the second ball valve 152 thereby opening the exhaust port for delivering the heated oil to the conduit 52 that leads to the heat exchanger 48. These piston pumps 140 act very much like hydraulic valve lifters in an internal combustion engine. Of course it will be understood that more than two such piston pumps could be employed, and that ideally they should discharge into a common reservoir 154 before the heated oil passes into the conduit Having described above my invention of a novel friction heat generator 26, it should be readily apparent to those skilled in this art that other modifications of the invention may be adopted without departing from the scope of the present invention. For example, this heating system could be employed in a tobacco barn where electrical power may not be available. An internal combustion engine may be substituted for the electric motor 30 and there may be a direct drive or a belt drive or a hydraulic transmission system that would drive both the longitudinal auger as well as the blower similar to the blower unit 46 of FIG. 1. Moreover, the cylindrical drum 56 need not be mounted in a horizontal position, it could be mounted in vertical position without detracting from its operability.

Modifications of this invention will occur to those skilled in this art, therefore, it is to be understood that this invention is not limited to the particular embodiments disclosed, but that it is intended to cover all modifications which are within the true spirit and scope of this invention as claimed.

What is claimed is:

1. In a closed cycle friction heat generator for use as the heat source of a furnace heating system, said generator comprising:

(a) an oil-filled cylindrical housing supporting a central rotatable drive shaft with a longitudinal auger having spiral blades in the nature of screw threads in close-fitting relationship with the interior wall of the cylindrical housing for pumping the oil from one end of the housing to the other, (b) an external power source joined to one end of the said shaft at a location outside the housing for turning the shaft at a high rate of speed for raising the temperature of the oil as the auger compresses and moves the oil centrifugally and axially within the housing, (c) and an auxiliary pumping means located within the housing and adjacent the exit end of the said auger, which pumping means is operable from the rotatable shaft, and a tangential discharge port in the housing within the plane of the said auxiliary pumping means for carrying off the heated oil from the said pumping means, (d) and a heat exchanger connected by conduit means to the said housing discharge port, and a fluid return port at the opposite end of the housing with additional conduit means connecting the heat exchanger to the said fluid return port so as to form a closed recycling heating system.

2. The invention as recited in claim 1 wherein the said auxiliary pumping means includes a rotary impeller joined to the shaft for delivering the heated oil from the auger to the said tangential discharge port at an increased volumetric capacity.

3. The invention as recited in claim 2 wherein a transverse baffle plate is interposed between the exit end of the auger and the said rotary impeller.

4. The invention as recited in claim 3 wherein the said baffle plate is provided with a plurality of holes spaced over the area of the plate.

5. The invention as recited in claim 3 wherein the said baffle plate has an enlarged central opening for receiving the said shaft as well as a dished central area serving to funnel the heated oil into the central portion of the rotary impeller.

6. The invention as recited in claim 1 wherein the said auxiliary pumping means comprises a plurality of piston pumps, and the said shaft carries a rotary cam whereby each piston pump operates in conjunction with the rotary cam, and each piston pump includes a discharge port passing through a wall of the cylindrical housing.

7. The invention as recited in claim 6 wherein each piston pump discharges into a common reservoir, and one of the said conduit means of the heat exchanger connects the heat exchanger to the said reservoir.

8. In a closed recirculating oil friction heat furnace comprising:

(a) a friction heat generator having a sealed cylindrical housing supporting a central rotatable shaft in the form of a longitudinal auger having spiral blades in the nature of screw threads working in close-fitting relationship with the cylindrical interior wall of the housing, the housing being supplied with a load of high temperature oil to be acted upon by the rotating auger as the friction heat transfer medium, (b) an external power source joined to one end of the auger shaft for turning the auger at a high rate of speed for slinging the oil outwardly from the center line of the housing as well as compressing the oil axially toward the delivery end of the housing, (c) and an auxiliary pumping means positioned within the delivery end of the housing adjacent the end of the auger blades, said pumping means comprising a series of rotary impeller blades joined to the auger shaft, (d) and a tangential discharge port formed in the side of the delivery end of the housing within the plane of the rotary impeller blades for carrying off the heated oil from the friction heat generator housing, (e) and a heat exchanger connected by conduit means to the said housing discharge port, and a fluid return port at the opposite end of the housing with additional conduit means connecting the heat exchanger to the said fluid return port so as to complete a closed recirculating oil friction heat system.

* * * * *